United States Patent [19]

Fowler

[11] 4,160,417

[45] Jul. 10, 1979

[54] ARMING-SAFING SYSTEM FOR AIRBORNE WEAPONS

[75] Inventor: Ronald J. Fowler, Columbus, Ohio

[73] Assignee: The United States of America as represented by the Secretary of the Navy, Washington, D.C.

[21] Appl. No.: 823,242

[22] Filed: Apr. 29, 1969

[51] Int. Cl.[2] ..... F42C 15/12; F42C 15/40; F42C 13/04; F42C 11/04

[52] U.S. Cl. ..... 102/221; 343/17.1 R

[58] Field of Search ..... 343/17.1; 102/70.2, 102/70.2 G

[56] References Cited

U.S. PATENT DOCUMENTS

| | | | |
|---|---|---|---|
| 2,640,161 | 5/1953 | Krasnow et al. | 102/70.2 P |
| 3,211,057 | 10/1965 | White, Jr. et al. | 102/70.2 |
| 3,227,899 | 1/1966 | Perdreaux | 102/70.2 |
| 3,332,077 | 7/1967 | Nard et al. | 343/17.1 X |

*Primary Examiner*—Samuel W. Engle
*Assistant Examiner*—Thomas H. Webb
*Attorney, Agent, or Firm*—R. S. Sciascia; Sol Sheinbein

[57] ABSTRACT

The system of the present invention basically consists of a detector unit mounted in each bomb or airborne weapon and operable upon interception of a signal emitted by an aircraft-mounted source. The required signal for arming is present only in a well defined zone below the aircraft and only in response to pilot command during weapon release. The signal consists of an unmodulated beam of high-energy photons (gamma rays) emitted by a radioisotope source on the aircraft. The weapon must fall well below the aircraft to see the signal. Geiger-Mueller tubes are used for radiation detectors and the resulting signal is processed to initiate the arming or fusing sequence. Power for the operation of the detector and associated electronics is transferred through the metallic covering of the weapon by means of a split-core transformer at the time of release. The power transferred is capable of operating the unit for the length of time it would normally take the weapon to fall through the signal zone; after which the weapon returns to a dormant, safe, state if no arming signal has been received.

7 Claims, 4 Drawing Figures

ARMING-SAFING SYSTEM FOR AIRBORNE WEAPONS

STATEMENT OF GOVERNMENT INTEREST

The invention described herein may be manufactured and used by or for the Government of the United States of America for government purposes without the payment of any royalties thereon or therefor.

BACKGROUND OF THE INVENTION

This invention relates to arming-safing systems for airborne weapons, and more particularly to systems for arming or safing air dropped weapons a predetermined distance below the aircraft.

The arming of air launched weapons upon release from an aircraft has been the subject of considerable research in recent years. Devices employed by the various systems have the common objective of arming the weapon only after a safe intentional separation of the weapon and aircraft has occurred. Lanyards or arming wires attached to the aircraft and designed to be pulled free of the weapon upon separation to initiate an arming sequence were quite satisfactory for relatively low speed aircraft. The development, however, of jet aircraft capable of operating at near sonic and supersonic speeds complicated the problem. Not only were lanyards or arming wires subject to excessive stresses in flight, but subsequent to weapon launch, the lanyards or arming wires buffeted and frequently damaged the aircraft.

Electrical arming systems appeared to be an answer to the problem, but the manifold increase in numbers and power of radio and radar equipment, especially aboard aircraft carriers, caused these systems to be hazardous to explosive ordnance. These hazards were present even with mechanical lanyards or arming wires, as electromagnetic energy could gain access to explosives through electrical cabling used for control or selection, or through any openings in the weapon casing. A system was needed that could operate through a completely sealed and electrically shielded case, providing means for the selection of weapon options in addition to providing for arming of the weapon. Such a system would provide inherent immunity to the serious hazards of electromagnetic radiation to ordnance.

In addition to being free of external mechanical or electromechanical connections and providing complete electrical shielding, a satisfactory remote arming system should have other desirable characteristics. The sealed-in components should be capable of long term inert storage, be ready for use with a minimum of preparation, and require no time-consuming or possibly hazardous loading or checkout procedure on the aircraft.

SUMMARY OF THE INVENTION

The present invention obviates the aforementioned shortcomings of the prior art by providing a system capable of arming air dropped weapons remote from the aircraft without the need for either mechanical or electrical connections between aircraft and weapon at the time of arming. This is accomplished by providing the aircraft with a source of gamma radiation, such as that disclosed in applicant's copending application, Ser. No. 800,837 filed Feb. 18, 1969; and by providing the weapon with a radiation detector together with circuitry for initiating the arming or fuzing sequence upon detection of the gamma radiation signal. The circuitry is such that normal background radiation falls far below its threshold of response.

The present invention posesses numerous other advantages not found in the prior art. It requires absolutely no wires, mechanical attachments, or mechanical openings in the weapon shell, thereby eliminating the problems associated with external cables and wires at supersonic or near-supersonic aircraft speeds. The complete mechanical integrity of the weapon skin without electrical connectors provides inherent immunity to the hazards of high power electromagnetic radiation. The arming device is normally inert and contains no source of energy prior to weapon launch. At the instant of launch, the power supply is energized for a brief period of time, after which the energy is totally dissipated so that none is left to actuate the arming device; therefore the weapon again becomes dormant and cannot receive an arming signal. This short life cycle provides an inherent safety factor under almost all conceivable accident situations. The unit is small in size and can be readily adapted to most conventional weapons almost without modification. The weapon-borne portion of the system can be made to fit into the existing connector hole in the weapon with the detector placed external to the existing weapon shell. This type of installation allows for easy retrofit to existing weapons and permits the system to be easily used during any transition period from a mechanical to a nucleonic arming system. Present electromechanical systems require cable and connector rigging which consumes a considerable amount of time for the loading and checking of the stores. This procedure adds to the turn-around time of the aircraft and therefore limits aircraft mission time. For the system of the present invention there are absolutely no mechanical or electrical attachments, adjustments, or alignments to be made. If the weapon is attached to the bomb rack hooks, it is ready to operate. Since there is no energy in the arming circuit, the weapon is dormant and completely safe and can be rapidly installed by untrained personnel without hazard.

OBJECTS OF THE INVENTION

It is a primary object of this invention to provide a new and improved arming-safing system for airborne weapons.

It is another object of this invention to provide an arming-safing system for airborne weapons which requires no mechanical or electrical connections between aircraft and weapon.

It is a further object of this invention to provide an arming-safing system for airborne weapons in which the arming device is normally inert and contains no source of energy prior to launch.

It is yet another object of this invention to provide an arming-safing system of such design that mechanical integrity of the weapon skin may be maintained.

It is a still further object of this invention to provide an arming-safing system for airborne weapons in which the period during which arming can take place is of very short duration immediately subsequent to launch.

BRIEF DESCRIPTION OF THE DRAWINGS

Other objects, advantages and novel features of the invention will become readily apparent upon consideration of the following detailed description when read in conjunction with the accompanying drawings wherein.

DESCRIPTION OF THE PREFERRED EMBODIMENT

Figure 1:
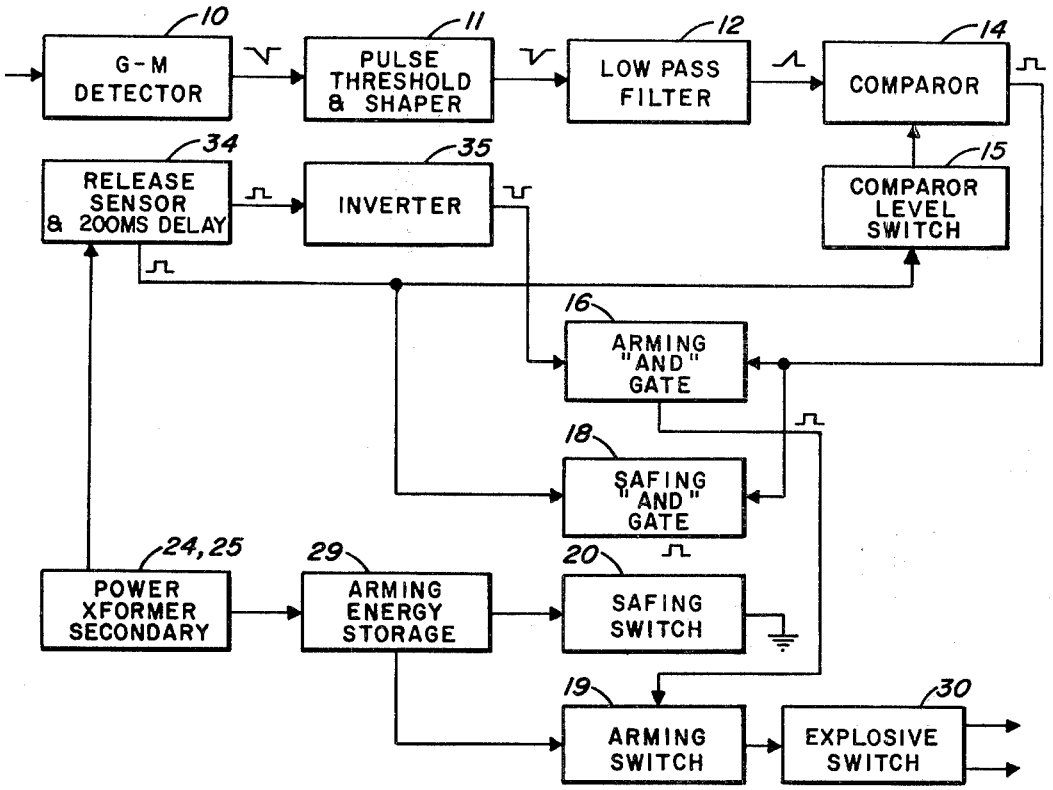
FIG. 1 is a block diagram of the arming-safing system of the present invention.

Referring now to FIG. 1, it can be seen that the system of this invention comprises a detector 10, such as a Geiger-Mueller tube, the output of which is fed to a pulse shaper 11 and then to a low pass filter 12. The output of the filter is applied to a dual-level comparor 14, such as a schmitt trigger, the level of which is controlled by a level switch 15. The comparor output is fed to an arming AND gate 16 and to a safing AND gate 18. The output of the arming AND gate is applied to an arming switch 19 and the output of the safing AND gate is applied to a safing switch 20.

Figure 2:
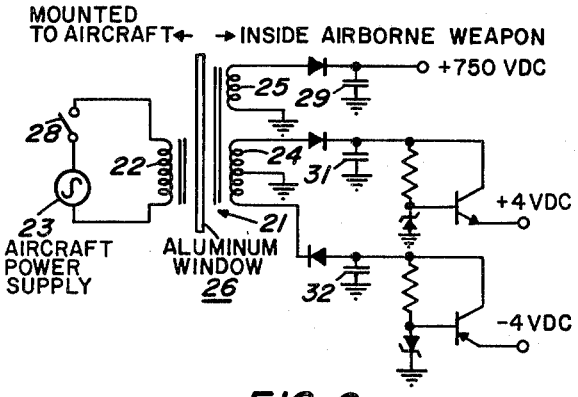
FIG. 2 is a circuit diagram of the power supply for the system of FIG. 1.

Attention now is directed to FIG. 2 wherein is disclosed the power supply for the system of FIG. 1. The power supply comprises a split-core transformer, designated generally by the reference numeral 21, having a primary winding 22 connected to the aircraft power supply 23 and having secondary windings 24 and 25 mounted inside of the airborne weapon. The weapon is provided with an aluminum window 26 of such thickness that energy may be transferred from the primary winding 22 to the secondary windings 24 and 25. The circuit containing the primary winding 22 also contains a switch 28 which is operable in conjunction with the weapon release mechanism (not shown) aboard the aircraft.

The secondary winding 25 forms part of a high voltage circuit which also includes a capacitor 29 for energy storage. After being charged, the capacitor 29 provides the high DC voltage necessary to operate the detector 10 and an explosive switch or arming squib 30 (FIG. 1). The secondary winding 24 forms part of a low voltage circuit which also includes capacitors 31 and 32 for energy storage. After being charged, the capacitors 31 and 32 provide the low positive and negative DC voltages necessary to operate the other elements of the system of FIG. 1.

OPERATION

In order that a better understanding of the invention may be had, its mode of operation will now be described. When the pilot of the plane carrying the weapon actuates the release mechanism, the switch 28 is closed energizing the primary winding 22 of the transformer 21. The release mechanism is so designed that the weapon is not actually free to fall until a nominal time period, on the order of twenty milliseconds, after the switch 28 has closed in order to allow the capacitors 29, 31 and 32 to become fully charged. Simultaneously with the release of the weapon, the sources of gamma radiation are exposed in the manner fully described in the aforementioned copending application.

Energization of the transformer 21 also causes activation of a trigger circuit 34 (FIG. 1) which is designed to remain on for a time period on the order of two hundred milliseconds. This period is calculated to allow time for the weapon to fall into the radiation zone below the aircraft. The trigger circuit 34 applies a positive signal to the comparor level switch 15 and to one side of the safing AND gate 18; and, through an inverter 35, a negative signal to one side of the arming AND gate 16.

Figure 3:
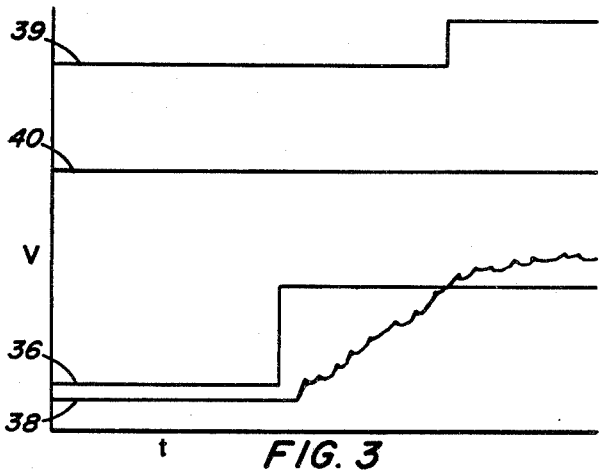
FIG. 3 represents oscilloscope traces obtained during normal operation of the system of FIG. 1.

The signal applied to the level switch 15 by the trigger circuit 34 establishes a low threshold as illustrated by the beginning of trace 36 (FIG. 3). Assuming that there is no high level of ambient radiation, the received signal 38 will be below the threshold of the comparor 14 and there will be no output signal from the comparor. Thus neither the arming nor safing AND gates will fire.

After the two hundred millisecond delay, the trigger circuit turns off and this then applies a negative signal to the comparor level switch 15 and to one side of the safing AND gate 18; and, through the inverter 35, a positive signal to one side of the arming AND gate 16. The level switch raises the threshold of the comparor as shown on trace 36. As the weapon is irradiated, the received signal 38 increases and exceeds the comparor threshold as shown in FIG. 3. The comparor then applies a positive signal to the arming and safing AND gate. Since only the arming AND gate 16 has a positive signal applied to its other input, only this gate will fire. This is illustrated by trace 39 in FIG. 3. The signal from the arming gate 16 then operates the switch 19 to discharge the capacitor 29 into the explosive switch 30. Firing of the explosive switch 30 will then complete the arming or fuzing sequence. Since the aforedescribed operations were all normal, the safing AND gate 18 never fired as illustrated by the straight trace 40 in FIG. 3.

Figure 4:
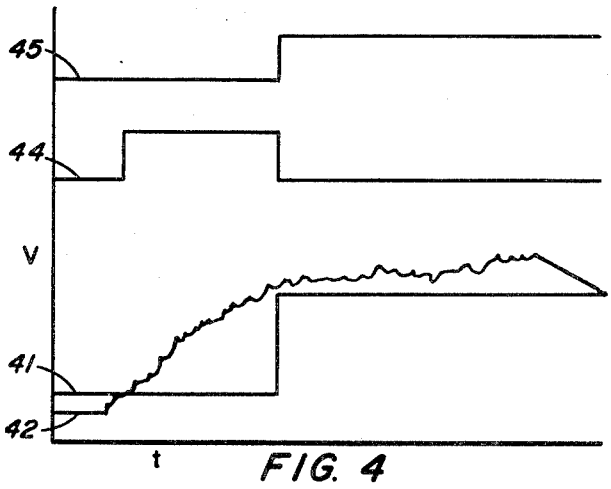
FIG. 4 represents oscilloscope traces obtained during abnormal operation of the system of FIG. 1.

Two species of abnormal operation will now be considered. Assuming that the weapon were provided with proximity fuzing, it would obviously be undesirable to arm the weapon before it was a safe distance from the aircraft. Such might be the case if the aircraft were in an area of high ambient radiation in the absence of provision to the contrary. FIG. 4 represents the signal traces when the background radiation is high. Trace 41 represents the comparor threshold and trace 42 the received signal. As can be seen in FIG. 4, the received signal exceeds the low level threshold of the comparor well before the trigger circuit 34 has timed out and raised the comparor level. When this happens, the comparor applies a positive signal to the safing and arming gates at a time when only the safing gate 18 has a positive signal on the other input. Thus only the safing gate fires at this time as illustrated by trace 44. The output of safing gate 18 operates the safing switch 20 which discharges the capacitor 29 to ground. When the trigger circuit 34 times out, the arming gate 16 will fire, as illustrated by trace 45. However, since the capacitor 29 was previously discharged, the explosive switch 30 will not fire and the weapon will remain inert. Another type of abnormal operation would occur if the weapon were torn free from the aircraft shackles due to violent maneuvering of the aircraft. In such a situation, since the release was not due to pilot command, the switch 28 would not have closed and no energy would have been transferred to the weapon. Thus the weapon would again remain inert.

It is to be understood that the aforedescribed arrangement of circuit elements is simply illustrative of a preferred embodiment of the invention. Manifestly, numerous other configurations may be readily devised by those skilled in the art to achieve a similar system still embodying the principles of the present invention and falling within the spirit and scope thereof.

What is claimed is:

1. A system for arming an airborne weapon in time delayed relation with respect to the release of the weapon from an aircraft in flight, the aircraft being provided with an unmodulated gamma radiation source for irradiating a predetermined volume of space below the aircraft, comprising:

means for detecting gamma radiation;

means for comparing the magnitude of the detected radiation to a predetermined radiation level and for generating a pulse when the radiation exceeds that level; and means responsive to a pulse from said comparing means for initiating the arming sequence for said weapon.

2. The system of claim 1 including:

means for transfering electrical energy from the aircraft to the weapon;

means for storing said energy; and safing means operable upon premature detection of radiation for discharging said energy storage means.

3. The system of claim 2 including;

time delay means for sequentially rendering said safing means effective while blocking said arming means and then rendering said arming means effective while blocking said safing means.

4. The system of claim 3 wherein:

said comparing means is dual level; and said time delay means switches said comparing means to its lower level while said safing means is effective and to its upper level when said arming means is effective.

5. The system of claim 3 wherein said arming means comprises:

an arming AND gate interconnecting said comparing means and said time delay means; and explosive switch means operable upon firing of said arming AND gate for initiating the arming sequence of said weapon.

6. The system of claim 3 wherein said safing means comprises:

a safing AND gate interconnecting said comparing means and said time delay means; and switch means operable upon firing of said safing AND gate for discharging said energy storage means.

7. A system for arming an airborne weapon in time delayed relation with respect to the release of the weapon from an aircraft in flight, the aircraft being provided with an unmodulated gamma radiation source for irradiating a predetermined volume of space below the aircraft through which the weapon would normally fall; comprising:

means for detecting gamma radiation;

dual-level means for comparing the magnitude of detected radiation to either of two predetermined radiation levels and for generating a pulse when the radiation exceeds these levels;

means for transfering electrical energy from the aircraft to the weapon upon release of the weapon;

means for storing said energy;

a trigger circuit turned on by transfer of electrical energy and operable when on to switch said comparing means to its lower level and when off to switch said comparing means to its higher level;

an arming AND gate interconnecting said trigger circuit and the output of said comparing means;

a safing AND gate interconnecting said trigger circuit and the output of said comparing means in parallel with said arming AND gate;

an inverter interposed between said trigger circuit and said arming AND gate whereby signals of opposite polarity will be applied by said trigger circuit to said arming and safing AND gates;

said trigger circuit being so biased that while on the signal applied to said safing AND gate is identical to the comparing means output and while off the signal applied to said arming AND gate is identical to the comparing means output;

means responsive to firing of said safing AND gate for discharging said energy storing means;

an explosive switch; and means responsive to firing of said arming AND gate for discharging said energy storing means into said explosive switch to initiate the arming sequence for the weapon.

* * * * *